US010277980B2

(12) United States Patent
Nishidate et al.

(10) Patent No.: US 10,277,980 B2
(45) Date of Patent: Apr. 30, 2019

(54) INFORMATION PROCESSING APPARATUS, INFORMATION PROCESSING SYSTEM, CONTROL METHOD, AND PROGRAM

(71) Applicant: SONY INTERACTIVE ENTERTAINMENT INC., Tokyo (JP)

(72) Inventors: Masaomi Nishidate, Tokyo (JP); Kiyoto Shibuya, Saitama (JP); Norihiro Nagai, Kanagawa (JP)

(73) Assignee: SONY INTERACTIVE ENTERTAINMENT INC., Tokyo (JP)

( * ) Notice: Subject to any disclaimer, the term of this patent is extended or adjusted under 35 U.S.C. 154(b) by 0 days.

(21) Appl. No.: 16/061,857

(22) PCT Filed: Jan. 30, 2017

(86) PCT No.: PCT/JP2017/003199
§ 371 (c)(1),
(2) Date: Jun. 13, 2018

(87) PCT Pub. No.: WO2017/135194
PCT Pub. Date: Aug. 10, 2017

(65) Prior Publication Data

US 2018/0376242 A1 Dec. 27, 2018

(30) Foreign Application Priority Data

Feb. 5, 2016 (JP) ..... 2016-021220

(51) Int. Cl.
*H04R 1/32* (2006.01)
*H04S 7/00* (2006.01)
*H04S 3/00* (2006.01)

(52) U.S. Cl.
CPC ..... *H04R 1/323* (2013.01); *H04S 3/002* (2013.01); *H04S 7/302* (2013.01); *H04S 7/307* (2013.01)

(58) Field of Classification Search
CPC combination set(s) only.
See application file for complete search history.

(56) References Cited

U.S. PATENT DOCUMENTS

2007/0230724 A1 10/2007 Konagai et al.

FOREIGN PATENT DOCUMENTS

JP 2004-527968 A 9/2004
JP 2005-101902 A 4/2005
(Continued)

OTHER PUBLICATIONS

International Search Report and Written Opinion dated Apr. 11, 2017, from the corresponding International Application No. PCT/JP2017/003199, 7 sheets.

(Continued)

*Primary Examiner* — Mark Fischer
(74) *Attorney, Agent, or Firm* — Katten Muchin Rosenman LLP

(57) ABSTRACT

To enhance the sound quality in the case where a directional speaker is used to allow a user to hear sounds coming from various directions. An information processing apparatus includes sound data acquisition means for acquiring data indicative of one piece of audio including treble audio and bass audio, volume determination means for determining a volume of the bass audio and a volume of the treble audio on the basis of a distance from a reflection position at which a sound from a high directional speaker is reflected to a user and a distance from a low directional speaker lower in directionality than the high directional speaker to the user, and speaker control means for making the low directional speaker output the bass audio and the high directional speaker output the treble audio on the basis of the determined volumes.

7 Claims, 8 Drawing Sheets

(56) References Cited

FOREIGN PATENT DOCUMENTS

| | | | |
|---|---|---|---|
| JP | 2006-25153 | A | 1/2006 |
| JP | 2010-56710 | A | 3/2010 |
| JP | 2012-49663 | A | 3/2012 |
| JP | 2012-156865 | A | 8/2012 |
| WO | 02/093773 | A1 | 11/2002 |

OTHER PUBLICATIONS

International Preliminary Report on Patentability dated Aug. 7, 2018, from the corresponding International Application No. PCT/JP2017/003199, 8 sheets.

| OUTPUT CONDITION | DIRECTION PARAMETER | BASS DATA | TREBLE DATA |
|---|---|---|---|
| OCCURRENCE OF EXPLOSION | POSITION OF EXPLOSION | L001.wav | H001..wav |
| EMERGENCE OF AIRPLANE | FRONT UPWARD OF USER | L002.wav | H002.wav |
| TRAVEL OF USER | DOWNWARD OF USER | L003.wav | H003.wav |

| CENTER COORDINATE OF REFLECTION SPOT | SOUND WAVE EMISSION DIRECTION | DISTANCE | ATTENUATION PARAMETER |
|---|---|---|---|
| (1.0,−1.0,1.0) | (θ,ϕ)= (45°,45°) | 1.5 | 0.3 |
| (−1.0,−1.0,2.0) | (θ,ϕ)= (45°,27°) | 2.0 | 0.5 |

INFORMATION PROCESSING APPARATUS, INFORMATION PROCESSING SYSTEM, CONTROL METHOD, AND PROGRAM

TECHNICAL FIELD

The present invention relates to an information processing apparatus, an information processing system, a control method, and a program.

BACKGROUND ART

Speakers (called parametric speakers) have been developed that are designed to output highly directional sounds so as to be heard in a particular direction. By use of these speakers, it has been practiced to make such sounds as advertisements reach people inside a limited range. It is known that a directional sound is reflected on a reflection surface so as to generate a sound from this reflection surface, thereby allowing a user to hear sounds coming from various directions.

CITATION LIST

Patent Literature

[PTL 1]
JP 2005-101902A
[PTL 2]
JP 2010-56710A
[PTL 3]
JP 2012-49663A
[PTL 4]
JP 2012-156865A

SUMMARY

Technical Problem

Generally, it is difficult for a highly directional speaker to output the sound of bass range. Therefore, use of a highly directional speaker in order to allow a user to hear sounds coming from various directions lowers sound quality as compared with allowing a user to hear only the sound outputted from a low directional speaker.

Therefore, the present invention addresses the above-identified problem and solves the addressed problem by providing a technology of enhancing the sound quality in the case where a directional speaker is used to allow a user to hear sounds coming from various directions.

Solution to Problem

In carrying out the invention and according to one aspect thereof, there is provided an information processing apparatus. This information processing apparatus has sound data acquisition means for acquiring data indicative of one piece of audio including treble audio and bass audio lower in frequency than the treble audio; volume determination means for determining a volume of the bass audio and a volume of the treble audio on a basis of a distance from a reflection position at which a sound from a high directional speaker is reflected to a user and a distance from a low directional speaker lower in directionality than the high directional speaker to the user; and speaker control means for making the low directional speaker output the bass audio and the high directional speaker output the treble audio on a basis of the determined volumes.

In carrying out the invention and according to another aspect thereof, there is provided and information processing system. This information processing system has a high directional speaker; a low directional speaker lower in directionality than the high directional speaker; sound data acquisition means for acquiring data indicative: of one piece of audio including treble audio and bass audio lower in frequency than the treble audio; volume determination means for determining a volume of the bass audio and a volume of the treble audio on a basis of a distance from a reflection position at which a sound from the high directional speaker is reflected to a user and a distance from the low directional speaker to the user; and speaker control means for making the low directional speaker output the bass audio and the high directional speaker output the treble audio on a basis of the determined volumes.

In carrying out the invention and according to still another aspect thereof, there is provided a control method. This control method has a step of acquiring data indicative of one piece of audio including treble audio and bass audio lower in frequency than the treble audio; a step of determining a volume of the bass audio and a volume of the treble audio on a basis of s distance from a reflection position at which a sound from a high directional speaker is reflected to a user and a distance from a low directional speaker lower in directionality than the high directional speaker to the user; and a step of making the low directional speaker output the bass audio and the high directional speaker output the treble audio on a basis of the determined volumes.

In carrying out the invention and according to yet another aspect thereof, there is provided a program for having a computer function as sound data acquisition means for acquiring data indicative of one piece of audio including treble audio and bass audio lower in frequency than the treble audio; volume determination means for determining a volume of the bass audio and a volume of the treble audio on a basis of a distance from a reflection position at which a sound from a high directional speaker is reflected to a user and a distance from a low directional speaker lower in directionality than the high directional speaker to the user; and speaker control means for making the low directional speaker output the bass audio and the high directional speaker output the treble audio on a basis of the determined volumes.

The present invention enhances the sound quality in the case where a directional speaker is used to allow a user to hear sounds coming from various directions.

In one embodiment of the present invention, the volume determination means may determine the volume of the bass audio and the volume ox the treble audio on a basis of the distance from the reflection position at which the sound from the high directional speaker is reflected to the user, the distance from the low directional speaker lower in directionality than the high directional speaker to the user, and information indicative of magnitude of attenuation of a sound at the reflection position.

In another embodiment of the present invention, the volume determination means may determine the volume of the bass audio and the volume of the treble audio on a basis of the distance from the reflection position at which the sound from the high directional speaker is reflected to the user, the distance from the low directional speaker lower in directionality than the high directional speaker to the user, and a distance between the reflection position and the high directional speaker.

In still another embodiment of the present invention, the information processing apparatus may further include attenuation parameter acquisition means for acquiring information indicative of magnitude of attenuation of sound at the reflection position on a basis of the sound from the high directional speaker reflected at the reflection position, the sound being entered in a microphone representative of the user.

In yet another embodiment of the present invention, the speaker control means may make the low directional speaker output bass audio acquired by applying a frequency filter to one piece of sound data including the treble audio and the bass audio.

DESCRIPTION OF EMBODIMENTS

The following describes embodiments of the present invention with reference to drawings. Of the components that appear in the following description, the components having functions same as those of other components are denoted by the same reference symbols and the description of the former will be skipped.

Figure 1:
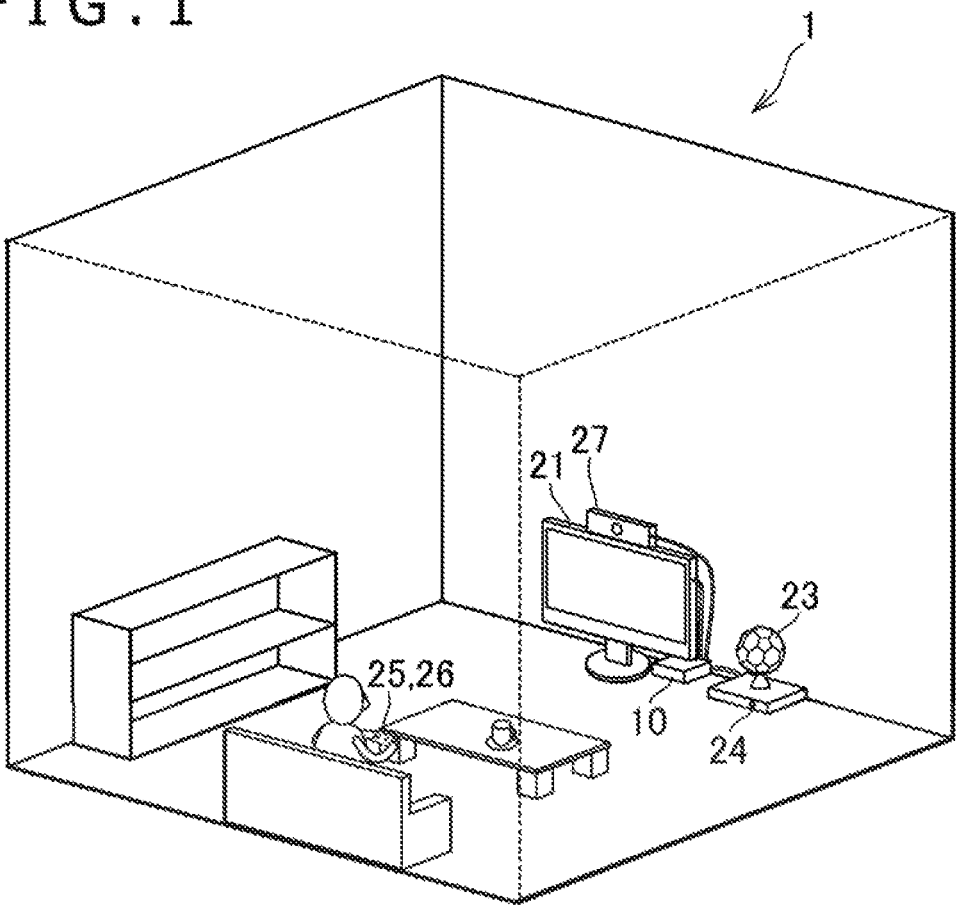
FIG. 1 is a diagram illustrating an example of use of an entertainment system practiced as one embodiment of the present invention.

FIG. 1 is a diagram illustrating an example of use of an entertainment system 1 practiced as one embodiment of the present invention. The entertainment system 1 has an information processing apparatus 10, a display 21, a normal speaker 22 unitized with the display 21, a directional speaker 23, a bass reproduction speaker 24, a controller 25, a microphone 26 unitized with the controller 25, and a camera unit 27. In the example illustrated in FIG. 1, the controller 25 and the microphone 26 are unitized to be held in the hand of the user. The controller 25 and the microphone 26 may be separate from each other. Further, the normal speaker 22 and the display 21 may be separate from each other.

The entertainment system 1 is used by a user inside a personal room arranged with various kinds of furniture and enclosed by wails on the four sides, for example. In the example illustrated in FIG. 1, the display 21 is arranged in front of the user and the directional speaker 23 is arranged in front of the user and on one side of the display 21. The camera unit 27 is arranged on the display 21.

For example, if the entertainment system 1 is used in the room described above, the information processing apparatus 10 controls the directional speaker 23 so as to generate sound effects from various positions in accordance with a game image displayed on the display 21 and a game progression situation, thereby providing the user with the game environment having a feeling of presence. To be more specific, if an explosion occurs in the back of a user character within a game, making a sound from the directional speaker 23 reflect from the wall in the back of the user allows the staging that the explosion sound actually comes from the back of the user. It should be noted that, in the present embodiment, the description is executed about the case in which the user plays a game mainly by use of the entertainment system 1; however, the present invention, is also applicable to the case in which moving images such as movies are viewed or only a sound is heard from a radio or the like.

Figure 2:
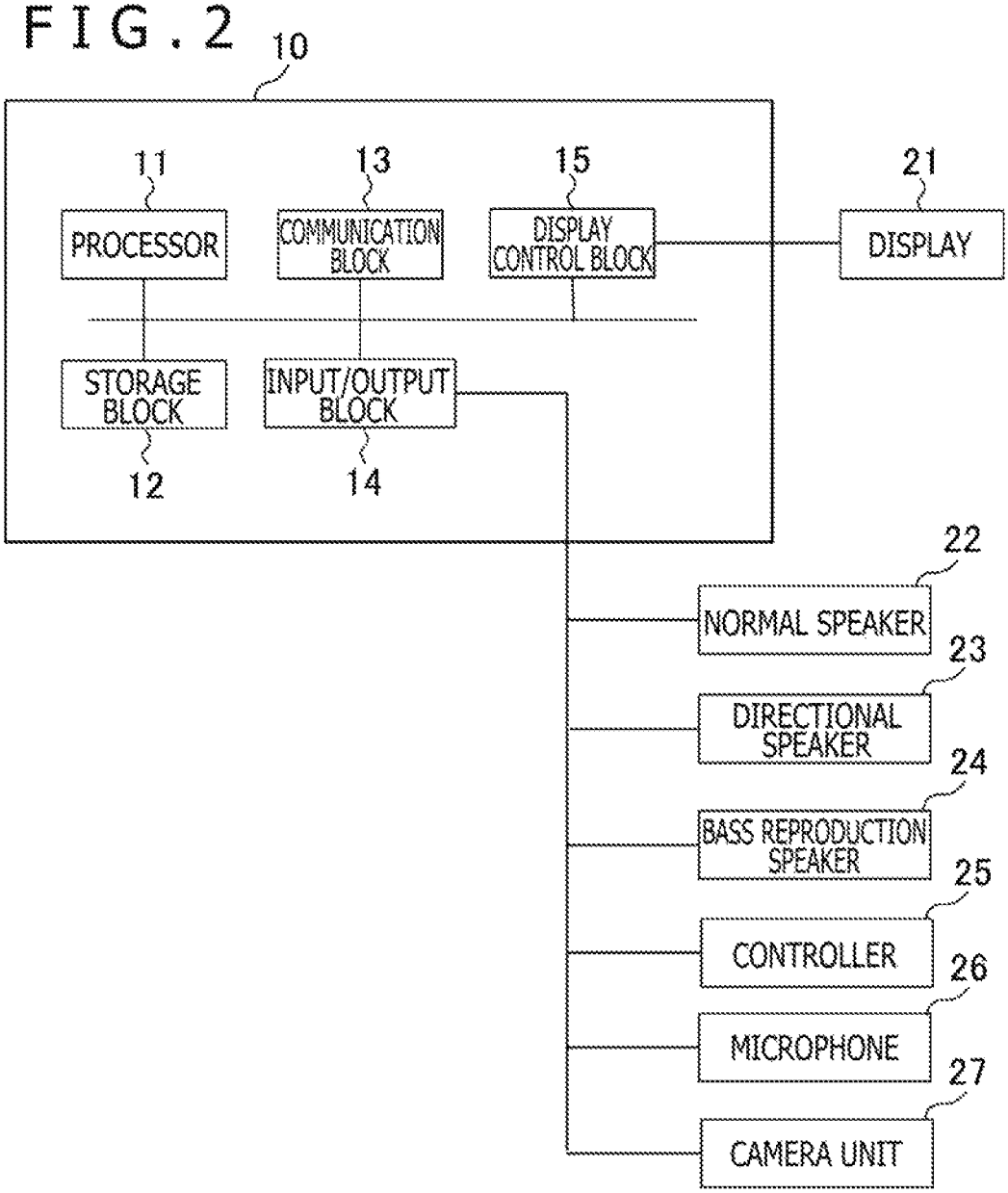
FIG. 2 is a diagram illustrating a hardware configuration of the entertainment system.

FIG. 2 is a diagram illustrating a hardware configuration of the entertainment system 1. The information processing apparatus 10 is a personal computer, a home game machine, or a personal digital assistant, for example. The information processing apparatus 10 has a processor 11, a storage block 12, a communication block 13, an input/output block 14, and a display control block 15, The processor 11 is a CPU (Central Processing Unit) or a GPU (Graphics Processing Unit), for example, and operates in accordance with a program stored in the storage block 12, thereby controlling the communication block 13, the input/output block 14, and the display control block 15. It should be noted that the above-mentioned program may be provided as stored in a computer-readable medium such as a flash memory or an optical disk or through a network such as the internet.

The storage block 12 is configured by a memory device such as a DRAM (Dynamic Random Access Memory) and a flash memory and an external storage apparatus such as a hard disk drive and an optical disk drive. The storage block 12 stores the above-mentioned program. In addition, the storage block 12 stores the information and computation results entered from the processor 11 and the communication block 13.

The communication block 13 is configured by an integrated circuit, a connector, and an antenna that configure a wired LAN (Local Area Network) or a wireless LAN. The communication block 13 has a function of communication with other apparatuses via a network. Under the control of the processor 11, the communication block 13 enters the information received from other apparatuses into the processor 11 and the storage block 12 and sends the information to other apparatuses.

The input/output block 14 is a USB (Universal Serial Bus) interface or Bluetooth (registered trademark) interface, for example, and is a circuit that provides an interface between an output device for outputting a sound and information to a user and an input device for entering a user operation, a sound, and an image and the processor 11 and the storage block 12. The input/output block 14 is connected to the normal speaker 22, the directional speaker 23, the bass reproduce ion speaker 24, the controller 25, the microphone 26, the camera unit 27, and a touch panel, for example. The input/output block 14 gets inputs from input devices such as the controller 25, the microphone 26, and the camera unit 27, for example, and enters the detected information into the processor 11 and the storage block 12. In addition, the input/output block 14 controls the output devices such as the normal speaker 22, the directional speaker 23, and the bass reproduction speaker 24.

The display control block 15 includes circuits (a frame buffer and a video signal generation circuit, for example) for controlling display output devices such as the display 21. Under the control of the processor 11, the display control block 15 displays an image on a display output device. It should be noted that the display 21 may be a home television receiver and the normal, speaker 22 may be a speaker built in the home television receiver. The normal speaker 22 is a general-purpose speaker capable of outputting sounds in both treble and bass ranges.

The directional speaker 23 is a parametric speaker, for example, and outputs the sound having directionality that is higher than that of general-purpose speakers. The directional speaker 23 outputs ultrasound wave in any one of two or more directions. The directional speaker 23 practiced as the present embodiment includes two or more ultrasound-wave sounding bodies and the direction in which each ultrasound-wave sounding body outputs sounds remains dynamically unchanged. Instead, the directional speaker 23 is made capable of outputting a highly directional sound in various directions by providing two or more ultrasound-wave sounding bodies in each of two or more directions. The ultrasound waves outputted from two or more ultrasound-wave sounding bodies in a certain direction are overlapped each other in the air to be converted from ultrasound wave to an audible sound. At this moment, since an audible sound is generated only in a part where ultrasound waves overlap each other, such an audible sound has a highly directional sound that can be heard only in the direction of the progression of the ultrasound waves. Further, when such a highly directional sound reflects from a reflection surface like a wall, for example, in a diffused manner, a non-directional sound results. This phenomenon can make the user feel as if the sound is generated from that reflection surface. Since the reflection surface for a sound outputted from the directional speaker 23 differs depending upon the output direction of an ultrasound wave, the user is able to feel the sounds coming from various directions.

The directional speaker 23 acquires the data (the sound data) indicative of an audio from the input/output block 14 and DA (Digital-to-Analog)-converts the acquired sound data, thereby outputting the sound. Since the frequency characteristic of the sound outputted from the directional speaker 23 is limited to a comparatively treble range, the sound data acquired by the directional speaker 23 may be the data limited to the audio of the treble range. It should be noted that the directional speaker 23 may have an actuator for changing the output directions of the sound of the ultrasound-wave sounding body. In this case, the actuator changes the direction of the ultrasound-wave sounding body so as to output the sound in various directions.

The bass reproduction speaker 24 is a speaker that is optimized to mainly output bass sounds and is also called a woofer. The bass reproduction speaker 24 outputs the sound in a sound range of a lower frequency than the sound range in which the directional speaker 23 outputs sounds. It should be noted that, since the bass is generally low in directionality, the directionality of the output sound in the bass reproduction speaker 24 is lower than that of the directional speaker 23 or the normal speaker 22. The bass reproduction speaker 24 may be arranged in the same housing as that of the directional speaker 23 or at a place adjacent to the directional speaker 23.

The controller 25 is used to enter user operations such as a game operation and character input, for example. The controller 25 converts a user operation into a signal and outputs this signal to the input/output block 14. The microphone 26 convers a sound into a signal and outputs this signal to the input/output block 14. The controller 25 and the microphone 26 may be arranged in the same housing or separate housings. The microphone 26 may foe any microphone that is arranged at a position representative of the user, for example, a place near the user. It should be noted that the controller 25 and the microphone 26 may be connected to the information processing apparatus 10 via a cable or in a wireless manner.

The camera unit 27 includes an imaging device and takes an image that is used for recognizing the position of the user. In addition, he camera unit 27 may cake an image for recognizing the reflection surface of the room. The camera unit 27 may take an image indicative of the size and position of the controller 25 for recognizing the position of the controller 25 or an image for use in the three-dimensional recognition techniques such as stereo camera and infrared scan. It should be noted that the camera unit 27 may be arranged in the same housing in which the directional speaker 23 is arranged.

Figures 3, 4:
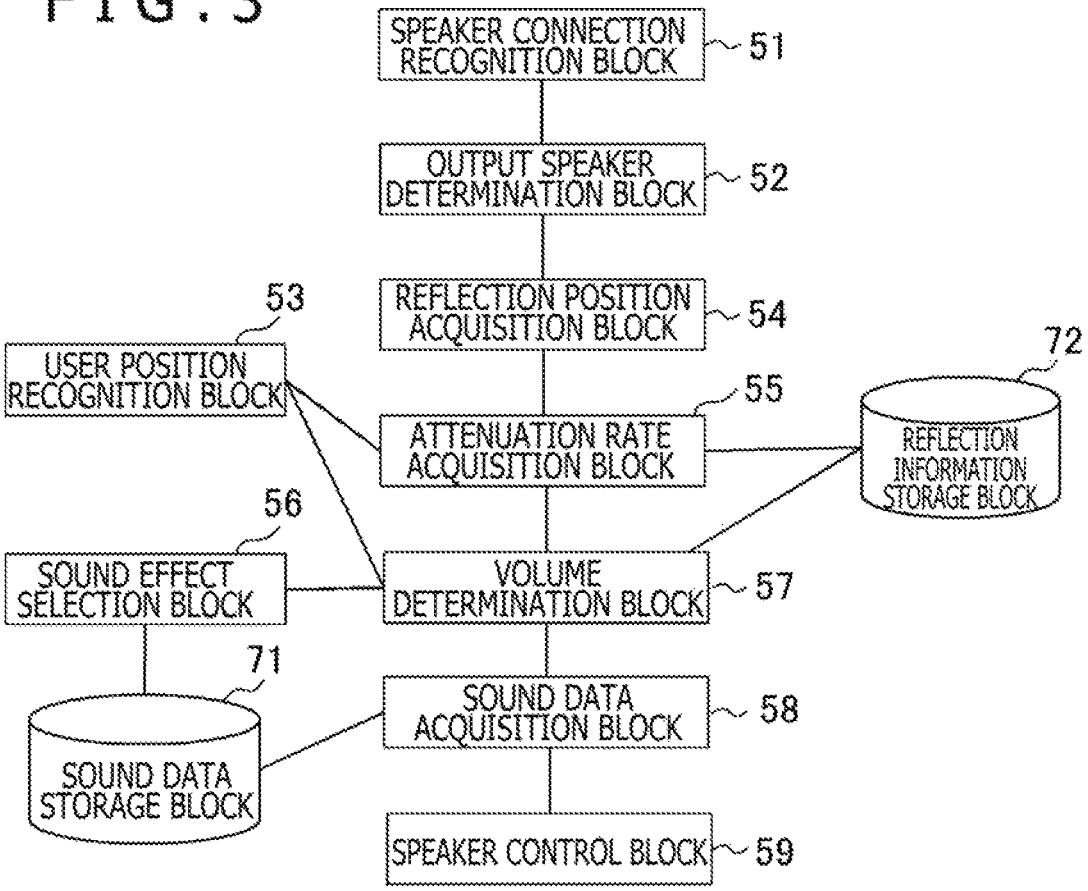
FIG. 3 is a functional block diagram illustrating functions to be realized by an information processing apparatus.
FIG. 4 is a diagram illustrating examples of sound data and control parameters that are stored in a sound data storage block.

FIG. 3 is a functional block diagram illustrating, functions to be realized by the information processing apparatus 10. Functionally, the information processing apparatus 10 included in the entertainment system 1 has a speaker connection recognition block 51, an output-speaker determination block 52, a user position recognition block 53, a reflection position acquisition block 54, an attenuation rate acquisition block 55, a sound effect selection block 56, a volume determination block 57, a sound data acquisition block 58, a speaker control block 59, a sound data storage block 71, and a reflection information storage block 72. Of these functions, the speaker connection recognition block 51, the output speaker determination block 52, the user position recognition block 53, the reflection position acquisition block 54, the attenuation rate acquisition block 55, the sound effect selection block 56, the volume determination block 57, the sound data acquisition block 58, and the speaker control block 59 are realised by the processor 11 by executing programs stored in the storage block 12 so as to control the input/output block 14 and store the processing results into the storage block 12. The sound data storage block 71 and the reflection information storage block 72 are realized mainly by the storage block 12.

The sound data storage block 71 holds two or more pieces of sound data such as game sound effects and control parameters related with each piece of sound data. One piece of sound data is indicative of one piece of audio that includes the treble audio outputted from the directional speaker 23 and the bass audio lower in frequency than the treble audio. The control parameters include output conditions indicative of conditions of a trigger by which the sound indicated by the sound data is outputted from the speaker and the directional parameters indicative of sound directions as viewed from the user.

FIG. 4 is a diagram illustrating an example of the sound data and control parameters stored in the sound data storage block 71. In the example illustrated in this diagram, the sound data is configured by the two types of data the bass data indicative of bass audio and the treble data indicative of treble audio. FIG. 4 illustrating the file names of the bass data and the treble data. For example, one record stored in the sound data storage block 71 stores bass data, treble data, output conditions, and directional parameters, the sound data and the control parameters being recorded as related with each other.

Each piece of the bass data and the treble data may be the data in which the treble audio or the bass audio is recorded by a known format such as PCM (Pulse Code Modulation) format, or mp3 format. Further, the treble data is the data indicative of the waveform of a sound heard by the user in the audible range; however, the treble data may be the data having a waveform of the ultrasound wave outputted through the directional speaker 23. The output conditions include conditions indicative of whether collision or explosion occurs or not or conditions indicative of a place at which a collision occurs, for example.

The reflection information storage block 72 stores the reflection information such as the attenuation rate and the like on a position at which an ultrasound wave outputted from the directional speaker 23 is reflected. Details of the reflection information will foe described later.

The speaker connection recognition block 51 acquires the information of a speaker connected to the information processing apparatus 10 from the input/output block 14 and the speaker connection recognition block 51 stores the information indicative whether the directional speaker 23 is connected or not and the information indicative whether the bass reproduction speaker 24 is connected or not into the storage block 12.

The output speaker determination block 52 determines a speaker from which to output treble audio and a speaker from which to output bass audio on the basis of the information indicative of the connection between the information processing apparatus 10 and the directional speaker 23 and the information indicative of the connection between the information processing apparatus 10 and the bass reproduction speaker 24 that are acquired by the speaker connection recognition block 51. In the present embodiment, the speaker from which to output treble audio is the directional speaker 23 or the normal speaker 22. The low directional speaker is the bass reproduction speaker 24 or the normal speaker 22. In what follows, if the directional speaker 23 is selected as a speaker from which to output treble audio, the speaker from which to output bass audio is written as a "low directional speaker."

The user position recognition block 53 acquires an image from the camera unit 27 via the input/output block 14, recognizes the position of a user inside a room by analyzing the acquired image, and stores the coordinates of this user into the storage block 12. For example, by use of a known face recognition technology, the user position recognition block 53 may detect from the image the face image of the user in the room so as to recognize that position as the user position. In addition, the user position recognition block 53 may recognise the shape of the controller 25 so as to recognize as the user position the position in the three-dimensional space of the controller 25 to be recognized on the basis of the position and size inside that image. It should be noted that the user position recognition block 53 may recognize the user position on the basis of the input/output of another device such as radar or ultrasound wave.

The reflection position acquisition block 54 acquires an image from the camera unit 27 via the input/output block 14 and analyzes this image so as to acquire a reflection position at which a sound outputted from the directional speaker 23 is reflected. To be more specific, the reflection position acquisition block 54 analyzes an image to select candidates of the reflection spot and calculates the three-dimensional position of the candidates as the reflection position. Here, the candidates of the reflection spot may each only be as large as 6 to 9 cm square; for example, the candidates may be parts of surface such as wall, desk, chair, or bookshelf. Also, in selecting candidates of the reflection spot, the reflection position acquisition block 54 may estimate the material and reflection rate of the surface of a matter by use of a known pattern matching technology so as to select as candidates of the reflection spot the surface of the matter of which estimated reflection rate is higher than a threshold value. The reflection position acquisition block 54 stores the information on the selected candidate of the reflection spot into the reflection information storage block 72.

Figures 5, 6:
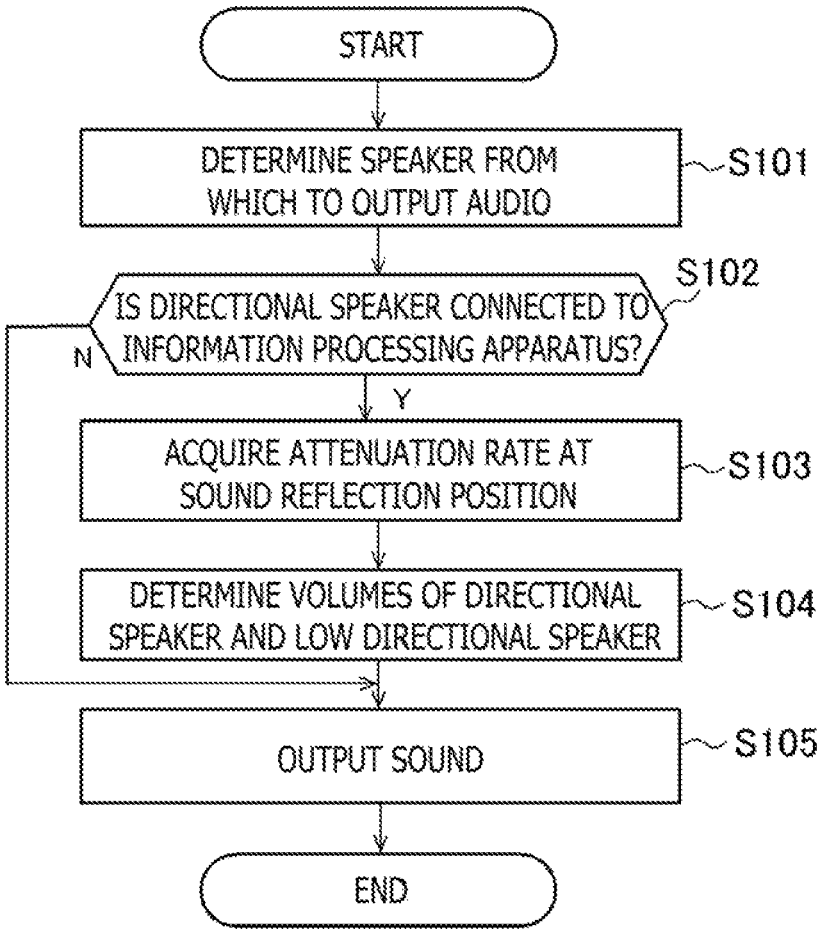
FIG. 5 is a diagram illustrating an example of information of a reflection spot that is stored in a reflection information storage block.
FIG. 6 is a processing flow diagram illustrating an overview of the processing to be executed by the information processing apparatus.

FIG. 5 is a diagram illustrating an example of the information on candidates of a reflection spot and the information on reflection position that are stored in the reflection information storage block 72. The information on candidates of a reflection spot includes the three-dimensional coordinate (the center coordinate) of the center of the reflection spot, the direction (the sound wave emission direction) of the reflection spot as viewed from the directional speaker 23, the distance from the directional, speaker 23 to the reflection spot, and the attenuation parameter that will be described later. The center coordinate is indicative of the reflection position. The reflection position acquisition block 54 calculates the direction of the normal line of the reflection spot and the distance from the directional speaker 23 to the reflection position on the basis of the coordinate and the direction of the directional speaker 23 entered in advance and the center coordinate of the reflection spot obtained by the analysis of the image.

On the basis of a sound from the directional speaker 23 that is reflected at a reflection position, the sound being entered in the microphone 26 at a position representative of a user, the attenuation rate acquisition block 55 acquires an attenuation parameter indicative of the magnitude of the attenuation of the sound that is generated when the sound is reflected at that reflection position. Details of this processing will be described later.

On the basis of the output conditions stored in the sound data storage block 71, the sound effect selection block 56 selects, from time to time, the sound that is outputted from a speaker. The sound to be selected by the sound effect selection block 56 may be a sound effect or music. Further, on the basis of the directional parameters stored as related with the output conditions, the sound effect selection block 56 determines the direction (the direction of sound as viewed from the user) in which the user has to sense the selected sound.

On the basis of a distance from a reflection position at which the sound from the directional speaker 23 is reflected to the user and a distance from a low directional speaker lower in directionality than the directional speaker 23 to the user, the volume determination block 57 determines the volume of bass audio and the volume of treble audio. In addition, further on the basis of the attenuation parameter indicative of the magnitude of the attenuation of the sound at the reflection position at which the sound from the directional speaker 23 is reflected, the volume determination block 57 may determine the volume of bass audio and the volume of treble audio. Further, on the basis of a distance from the directional speaker 23 to the reflection position, the volume determination block 57 may determine the volume of bass audio and the volume of treble audio.

The sound data acquisition block 58 acquires the sound data indicative of one piece of audio including treble audio and bass audio from the sound data storage block 71. To be more specific, the sound data acquisition block 58 acquires the sound data of the sound selected by the sound effect selection block 56.

On the basis of the volume of bass audio and the volume of treble audio determined by the volume determination block 57, the speaker control block 59 makes the low directional speaker output the bass audio and the high directional speaker output the treble audio.

The following describes a flow of the processing to be executed by the information processing apparatus 10 in outputting sounds in a game or the like. FIG. 6 is a processing flow diagram illustrating an overview of the processing to be executed by the information processing apparatus 10. First, the information processing apparatus 10 determines a speaker from which to output audio in starting a program of a game or the like (step S101). Next, if the directional speaker 23 is connected to the information processing apparatus 10 (Y of step S102), then the processing operations of steps S103 and S104 are executed; if the directional speaker 23 is not connected to the information processing apparatus 10 (N of step S102), then the processing operations of steps S103 and S104 are skipped.

In step S103, the information processing apparatus 10 acquires an attenuation rate at the reflection position at which the sound emitted from the directional speaker 23 is reflected. Then, the information processing apparatus 10 determines the volumes of the directional speaker 23 and the low directional speaker for the sound selected by the sound effect selection block 56 as the subject of output (step S104). Next, the information processing apparatus 10 makes the speaker selected in step S101 output, the sound selected by the sound effect selection block 56 as the subject of output (step S105). Actually, the processing operations of steps S104 and S105 are executed if the sound outputted from the speaker is selected by the sound effect selection block 56 when the output conditions stored in the sound data storage block 71 are satisfied.

Here, the speaker connection recognition block 51 and the output speaker determination block 52 execute the processing of step S101. The user position recognition block S3, the reflection position acquisition block 54, and the attenuation rate acquisition block 55 execute the processing of step S103. The volume determination block 57 executes the processing of step S104. The sound data acquisition block 58 and the speaker control block 59 execute the processing of step S105.

Figure 7:
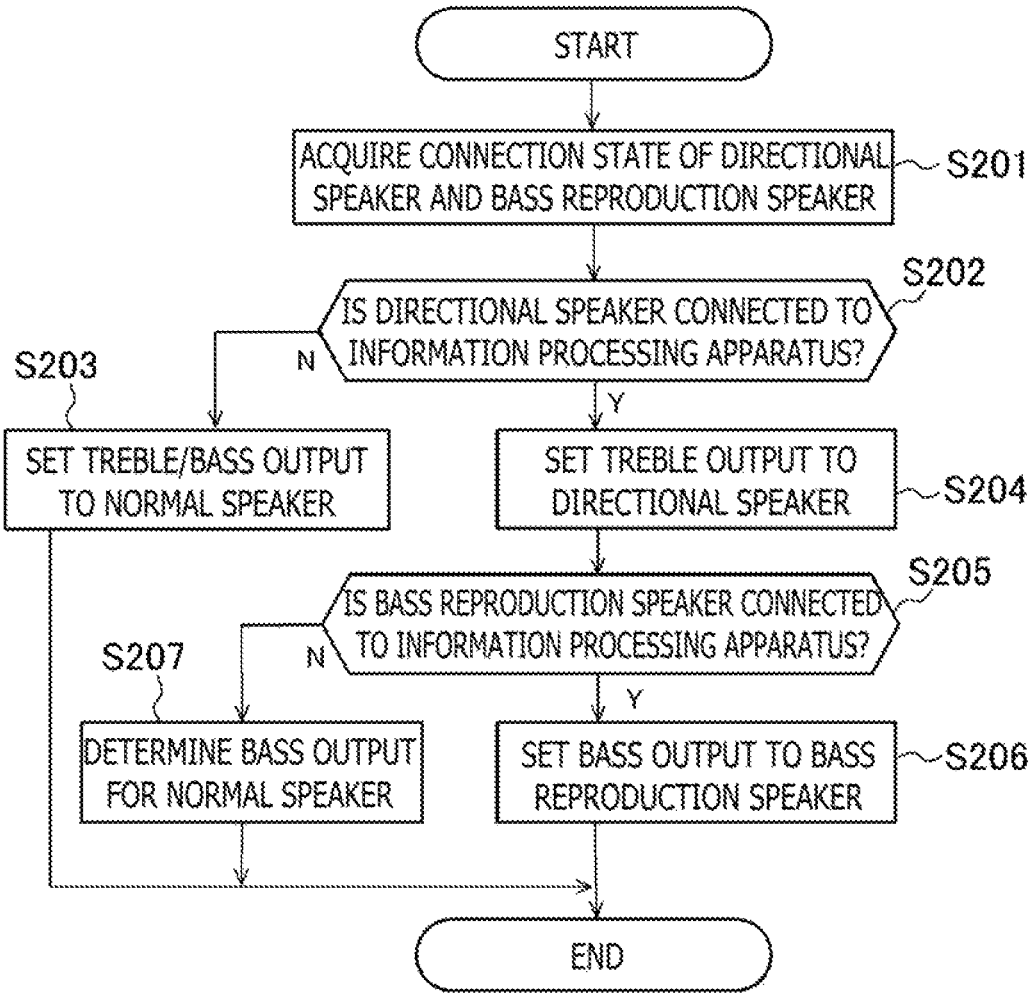
FIG. 7 is a flowchart indicative of an example of the processing to be executed by a speaker connection recognition block and an output speaker determination block.

The following describes details of the processing of step S101. FIG. 7 is a flowchart indicative of an example of the processing to be executed by the speaker connection recognition block 51 and the output speaker determination block 52. First, the speaker connection recognition block 51 acquires a connection state indicative of whether the directional speaker 23 and the bass reproduction speaker 24 are connected to the information processing apparatus 10 from the input/output block 14 (step S201). Next, if the directional speaker 23 is found not connected to the information processing apparatus 10 (N of step S202), then the output speaker determination block 52 sets the output destination of bass and treble sounds to a speaker set as default to the information processing apparatus 10 as with the normal speaker 22, for example (step S203). In what follows, the case in which the default speaker is the normal speaker 22 will fee described. On the other hand, if the directional speaker 23 is found connected to the information processing apparatus 10 (Y of step S202), then the output speaker determination block 52 sets the output destination of treble to the directional speaker 23 (step S204). After step S204, on the basis of the result of the processing by the speaker connection recognition block 51, the output speaker determination block 52 determines whether the bass reproduction speaker 24 is connected to the information processing apparatus 10 (step S205). If the bass reproduction speaker 24 is found connected to the information processing apparatus 10 (Y of step S205), then the output speaker determination block 52 sets the output destination of bass to the bass reproduction speaker 24 (step S206). If the bass reproduction speaker 24 is found not connected to the information processing apparatus 10 (N of step 3205), then the output speaker determination block 52 sets the output destination of bass to the normal speaker 22 (step 3206).

Figure 8:
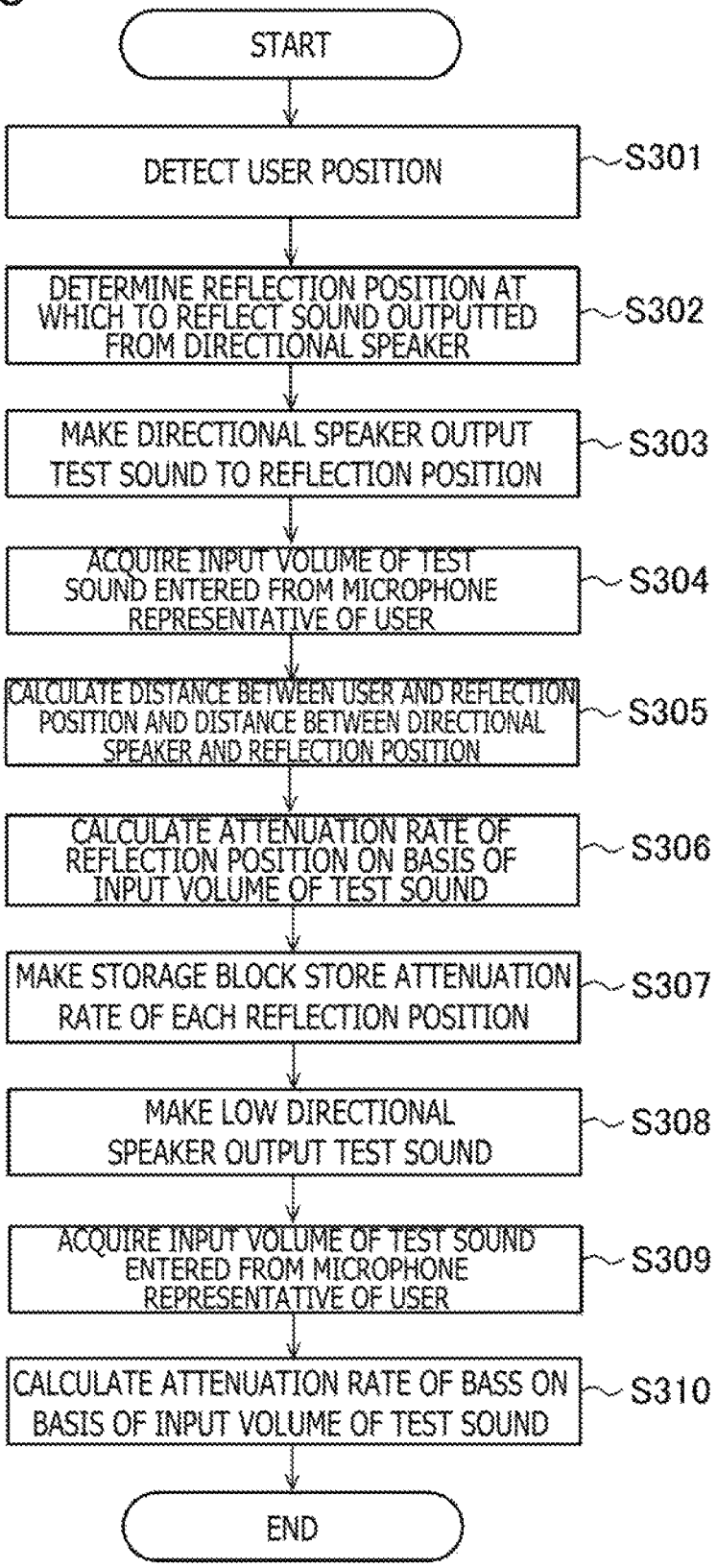
FIG. 8 is a flowchart indicative of an example of the processing to be executed by a user position recognition block, a reflection position acquisition block, and an attenuation rate acquisition block.

The following describes the processing of step S103. FIG. 8 is a flowchart indicative of an example of the processing to be executed by the user position recognition block 53, the reflection position acquisition block 54, and the attenuation rate acquisition block 55 in step S102. First, the user position recognition block 53 detects the position of the user in the room in which the directional, speaker 23 arid the camera unit 27 are installed (step S301). To be more specific, on the basis of an image of the user or the controller 25 taken by the camera unit 27, for example, the user position recognition block 53 detects the position of the user. Next, the reflection position acquisition block 54 determines candidates of a reflection position at which to reflect the sound outputted from the directional speaker 23 as illustrated in FIG. 5, for example (step 3302).

When the candidates of the reflection position are determined, the attenuation rate acquisition block 55 makes the directional speaker 23 output a test sound to each of the candidates of the reflection position (step S303). Then, for each of the candidates of the reflection position, the attenuation rate acquisition block 55 acquires the input volume of the test sound entered from the microphone 26 at a position representative of the: user (step S304). Also, for each of the reflection positions, the attenuation rate acquisition block 55 acquires a distance between the position of the user detected in step S301 and the reflection position at which the test sound is reflected and a distance between the directional speaker 23 and the reflection position thereof (step S305). Each distance is calculated from a squared difference between each element of the coordinates of the user position and each element of the coordinates of the reflection position, for example, and a distance between the directional speaker 23 and the reflection position thereof is the distance stored in the reflection information storage block 72 that is obtained from the sum of the square of each element of the coordinates of the directional speaker 23 and each element of the coordinates of the reflection position, for example.

Figure 9:
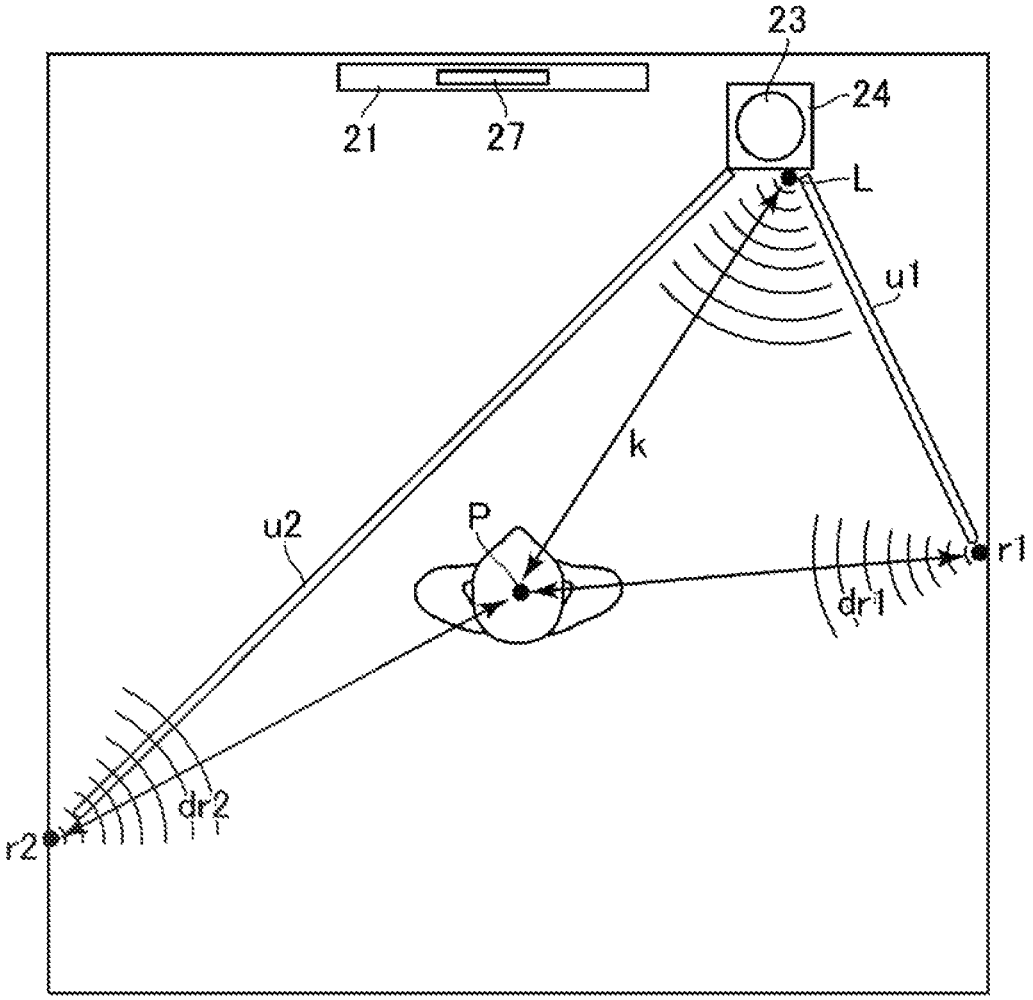
FIG. 9 is a diagram schematically illustrating the reflection of sound from a directional speaker and the output of sound from a bass reproduction speaker.

FIG. 9 is a diagram schematically illustrating the reflection of the sound from the directional speaker 23 and the output of the sound from the bass reproduction speaker 24. For example, if the directional speaker 23 emits ultrasound wave u1 toward reflection position r1 in FIG. 9, then ultrasound wave u1 is reflected at reflection position r1 so as to provide the sound in the audible range, thereby reaching user position P. Then, the user recognizes the sound coming from reflection position r1 on the right side. Likewise, if the directional speaker 23 emits ultrasound wave u2 toward reflection position r2, then the user recognizes the sound coming from reflection position r2. It should he noted here that, while highly directional, ultrasound waves are easily attenuated in the air. Further, the magnitude of the sound in the audible range caused by the reflection of an ultrasound wave depends on the material of the reflection position or an incident angle thereto. Obviously, the magnitude of the audible sound also depends on distance dr1 from reflection position r1 to user position P and distance dr2 from reflection position r2 to user position P. Therefore, the relation between the volume of the sound outputted from the directional speaker 23 and the volume of the sound reaching the user depends on the distance from the directional speaker 23 to the reflection position, the attenuation rate due to the material and the like of the reflection position, and the distance from user position P to the reflection position. On the other hand, with respect to the bass audio outputted by the low directional speaker from bass output position L, the magnitude of the attenuation depends on distance k between bass output position L and user position P and the sound reflection rates of floor, wall, and the like. The following describes a method of calculating attenuation rate Ar due to the material and the like of the reflection position with respect to the treble audio outputted from the directional speaker 23.

On the basis of the input volume of a test, sound, the attenuation rate acquisition block 55 calculates the attenuation rate of the reflection position (step S306). Let the output volume of a test sound from the directional speaker 23 be Vout, the input volume of a test sound in the microphone 26 be Vin, the distance from the directional speaker 23 to the reflection position be du, and the distance from the reflection position to the user be dr, then the attenuation rate acquisition block 55 calculates attenuation rate Ar by use of the following equation.

$$Ar = \frac{Vin}{Vout} \times \frac{1}{F(du)} \times dr^2 \quad \text{[Math. 1]}$$

Here, F(du) is a function indicative of a value obtained by dividing the volume immediately before the reflection at the reflection position by the output volume of the directional speaker 23, namely, a function indicative of the attenuation of ultrasound wave in the air. Attenuation rate Ar is a type of attenuation parameter indicative of the magnitude of the attenuation at the reflection position. It should be noted that the attenuation rate acquisition block 55 may obtain an attenuation rate obtained by further removing the influence of incident angle.

Next, the attenuation rate acquisition block 55 makes the storage block 12 store the attenuation rate for each reflection position the reflection information storage block 72) as an attenuation parameter (step S307).

It should be noted that the attenuation rate acquisition block 55 may calculate, as an attenuation parameter, parameter Au that is obtained by summarizing the influence of du and the influence of attenuation rate Ar at the reflection position. The equation with which the attenuation rate acquisition block 55 obtains parameter Au is as follows:

$$Au = \frac{Vin}{Vout} \times dr^2 \quad \text{[Math. 2]}$$

Further, the attenuation rate acquisition block 55 may calculate, as an attenuation parameter, attenuation parameter Ah that includes the influence of du and the influence of attenuation rate Ar at the reflection position, and the influence of the distance from the reflection position to user position P. If there is no change in the user position between the timing at which a test sound is outputted and the timing at which an actual sound effect and the like are outputted, use of attenuation parameter Ah does not cause any problem. Attenuation parameter Ah is a parameter based on the distance from the reflection position to user position F. The equation with which the attenuation rate acquisition block 55 obtains attenuation parameter Ah is as follows:

$$Ah = \frac{Vin}{Vout} \quad \text{[Math. 3]}$$

After the processing of step S307, the attenuation rate acquisition block 55 outputs a test sound from the low directional speaker (step S308). Then, the attenuation rate acquisition block 55 acquires the input volume of the test sound entered from the microphone 26 at the position representative of the user (step S309). Next, on the basis of the input volume of the test sound, the attenuation rate acquisition block 55 calculates the attenuation rate of bass (step S310). To be more specific, the attenuation rate acquisition block 55 calculates, as the attenuation rate of bass, a value obtained by dividing the input volume of a test sound by the output volume of a test sound outputted from the low directional speaker at bass output position L, for example.

Figure 10:
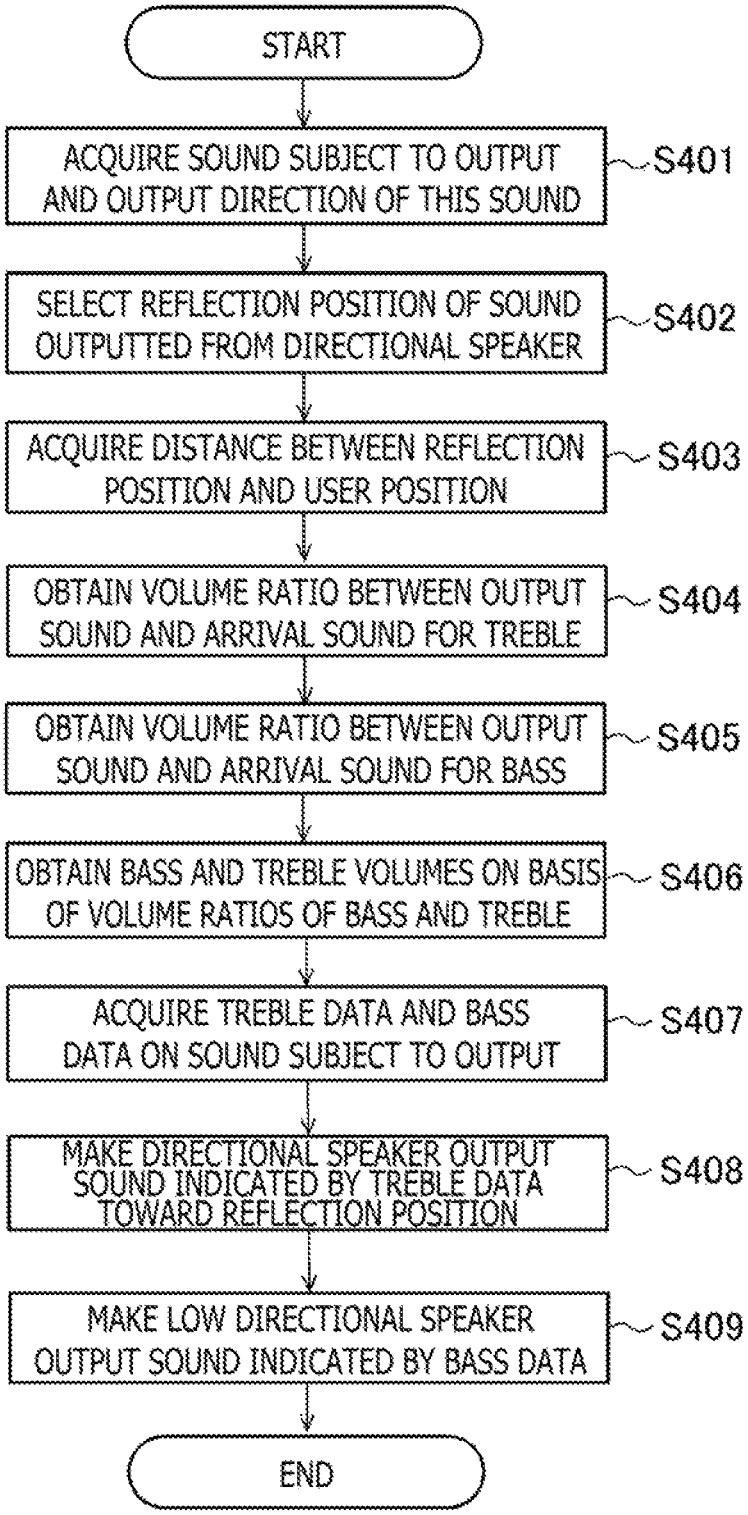
FIG. 10 is a flowchart indicative of an example of the processing to be executed by a volume determination block, a sound data acquisition block, and a speaker control block.

The following describes the processing operations of step S104 and step S105 to be executed if the directional speaker 23 is connected to the information processing apparatus 10. FIG. 10 is a flowchart indicative of an example of the processing to be executed by the volume determination block 57, the sound data acquisition block 58, the speaker control block 59.

First, the volume determination block 57 acquires the type of the sound subject to output selected by the sound effect selection block 56 and the direction of this sound as viewed from the user (step S401). Next, the volume determination block 57 selects, from two or more reflection positions stored in the reflection information storage block 72, the reflection position of the sound outputted from the directional speaker 23, this reflection position being in the direction of the sound as viewed from the user (step S402). Here, the volume determination block 57 may select the reflection position in the direction nearest to the direction of the sound as viewed from the user or select, from the reflection positions of which attenuation rates are higher than a threshold value, the reflection position in the direction nearest to the direction of the sound as viewed from the user. It should be noted that, the volume determination block 57 may detect the reflection position in the direction nearest to the direction of the sound as viewed from the user by searching for the reflection position nearest to a line segment extended to the direction of the sound from the user position recognized by the user position recognition block 53. The user position used here may be the position obtained in step S301 or the position newly acquired by the user position recognition block S3.

Next, the volume determination block 57 acquires distance dr between the selected relection position and the user position (step S403). This distance is calculated in the same method as that of step S305. Then, the volume determination block 57 obtains, with respect to treble, a volume ratio in the volume between the output sound outputted from she directional speaker 23 and the arrival sound reaching the user (the volume ratio for treble) (step S404). Let the volume of output sound be Vout and the volume of arrival sound be Vg, then the volume determination block 57 obtains volume ratio Vg/Vout on the basis of the following equation:

$$\frac{Vg}{Vout} = F(du) \times Ar \times \frac{1}{dr^2} \quad \text{[Math. 4]}$$

As seen from the equation mentioned above, the volume ratio between the output sound outputted from the directional speaker 23 and the arrival sound for treble is calculated on the basis of the attenuation rate at the reflection position, distance dr between the reflection position and the user position, and distance du from the directional speaker 23 to the reflection position. Here, if distance du from the directional speaker 23 to the reflection position is not large, the influence of F(du) may be ignored, namely, the volume determination block 57 may calculate volume ratio Vg/Vout by an equation that does not include F(du). Also, the volume determination block 57 may calculate volume ratio Vg/Vout by use of attenuation parameter Au instead of F(du)×Ar.

It should be noted that the volume determination block 57 may obtain volume ratio Vg/Vout between the treble output sound and arrival sound by use of attenuation parameter Ah. In this case, attenuation parameter Ah for the selected reflection position is the volume ratio. Since attenuation parameter Ah is based on distance dr, volume ratio Vg/Vout is also a value that is obtained on the basis of distance dr; further, volume ratio Vg/Vout is also a value that is calculated on the basis of distance du from the directional speaker 23 to the reflection position and attenuation rate Ar of the reflection position.

Further, the volume determination block 57 obtains a volume ratio between the bass output sound outputted by the low directional speaker and the bass arrival sound reaching the user (step S405). Here, the volume determination block 57 obtains the bass attenuation rate obtained in step S310 as the volume ratio for bass. Since the attenuation rate changes xn accordance with the distance from the low directional speaker to the user for the relation between the bass output sound and arrival sound, the volume ratio for bass is acquired on the basis of the distance from the low directional speaker to the user.

Then, on the basis of the volume ratios for bass and treble, the volume determination block 57 obtains the bass volume of sounds outputted by the low directional speaker and the treble volume of sounds outputted by the directional speaker 23 (step S406). To be more specific, the volume determination block 57 obtains the bass and treble volumes such that the ratio between the treble volume ratio and the bass volume ratio becomes a predetermined value (1:1, for example) and the effective volume calculated from the bass volume and the treble volume becomes a predetermined value.

When the bass and treble volumes are determined, the sound data acquisition block 58 acquires the treble data and the bass data on the sound subject to output from the sound data storage block 71 (step S407). Then, the speaker control block 59 makes the directional speaker 23 output the sound indicated by the treble data in the determined treble volume toward the reflection position (step S408). Strictly, the speaker control block 59 makes the directional speaker 23 output the ultrasound wave with the sound indicated by the treble data modulated, further, in parallel and synchronization with the processing of step S408, the speaker control block 59 makes the low directional speaker output the sound indicated by the bass data in the determined bass volume (step S409).

As described above, the bass sounds that it is difficult for the directional speaker 23 to output are complemented by a low directional speaker that outputs bass sounds with a proper balance, thereby enabling the enhancement in the quality of sound that the user feels. Further, since it is difficult for the user to identify the direction in which bass sounds come and, actually, the user recognises the sound direction by treble, the recognition of the sound direction by the user is not hampered.

It should be noted that, if it is determined by the output speaker determination block 52 to output bass and treble sounds through the normal speaker 22, then the processing operations of steps S401 through S406 are not steps S408 and S409, the speaker control block 59 mixes the sound indicated by the treble data and the sound indicated by the bass data so as to make the normal speaker 22 output the mined sounds. Consequently, without separately preparing the sound data for the case in which the directional speaker 23 is connected and the case in which the directional speaker 23 is not connected, both the cases are satisfied by the setup described above.

It should also be noted that, instead of the two pieces of data, namely, the bass data and the treble data, one piece of data that includes both treble audio and bass audio may be stored in the sound data storage block 71 in advance. In this case, if the directional speaker 23 is connected, the speaker control block 59 makes the low directional speaker output the bass audio that is obtained by cutting sounds in the treble range that can be outputted by the directional speaker 23 by use of a lowpass filter, a type of frequency filter in step S409, for example. Especially, if the low directional speaker is the normal speaker 22, use of a lowpass filter allows the output of treble sounds from the normal speaker 22, thereby preventing the recognition of sound directions from being affected. Further, it is also practicable to acquire the treble audio outputted through the directional speaker 23 by applying a highpass filter, a type of frequency filter, to the sound indicated by the sound data so as to make the directional speaker 23 output the sound applied with the highpass filter.

The invention claimed is:

1. An information processing apparatus comprising:

sound data acquisition means for acquiring data indicative of one piece of audio including treble audio and bass audio lower in frequency than the treble audio;

volume determination means for determining a volume of the bass audio and a volume of the treble audio on a basis of a distance from a reflection position at which a sound from a high directional speaker is reflected to a user and a distance from a low directional speaker lower in directionality than the high directional speaker to the user; and speaker control means for making the low directional speaker output the bass audio and the high directional speaker output the treble audio on a basis of the determined volumes.

2. The information processing apparatus according to claim 1, wherein the volume determination means determines the volume of the bass audio and the volume of the treble audio on a basis of the distance from the reflection position at which the sound from the high directional speaker is reflected to the user, the distance from the low directional speaker lower in directionality than the high directional speaker to the user, and information indicative of magnitude of attenuation of a sound at the reflection position.

3. The information processing apparatus according to claim 1, wherein the volume determination means determines the volume of the bass audio and the volume of the treble audio on a basis of the distance from the reflection position at which the sound from the high directional speaker is reflected to the user, the distance from the low directional speaker lower in directionality than the high directional speaker to the user, and a distance between the reflection position and the high directional speaker.

4. The information processing apparatus according to claim 1, further comprising:

attenuation parameter acquisition means for acquiring information indicative of magnitude of attenuation of sound at the reflection position on a basis of the sound from the high directional speaker reflected at the reflection position, the sound being entered in a microphone representative of the user.

5. The information processing apparatus according to claim 1, wherein the speaker control means makes the low directional speaker output bass audio acquired by applying a frequency filter to one piece of sound data including the treble audio and the bass audio.

6. A control method comprising:

acquiring data indicative of one piece of audio including treble audio and bass audio lower in frequency than the treble audio;

determining a volume of the bass audio and a volume of the treble audio on a basis of a distance from a reflection position at which a sound from a high directional speaker is reflected to a user and a distance from a low directional speaker lower in directionality than the high directional speaker to the user; and making the low directional speaker output the bass audio and the high directional speaker output the treble audio on a basis of the determined volumes.

7. A non-transitory computer readable medium having stored thereon a program for a computer, the program comprising:

acquiring, by sound data acquisition means, data indicative of one piece of audio including treble audio and bass audio lower in frequency than the treble audio;

determining, by volume determination means, a volume of the bass audio and a volume of the treble audio on a basis of a distance from a reflection position at which a sound from a high directional speaker is reflected to a user and a distance from a low directional speaker lower in directionality than the high directional speaker to the user; and making, by speaker control means, the low directional speaker output the bass audio and the high directional speaker output the treble audio on a basis of the determined volumes.

* * * * *